US007813661B2

(12) United States Patent
Yacoub et al.

(10) Patent No.: US 7,813,661 B2
(45) Date of Patent: Oct. 12, 2010

(54) PRINTING ON CONDUCTIVE SUBSTRATE MATERIAL

(75) Inventors: Naseem Yacoub, Rehovot (IL); Ran Soffer, Yavne (IL)

(73) Assignee: Hewett-Packard Development Company, L.P., Houston, TX (US)

( * ) Notice: Subject to any disclaimer, the term of this patent is extended or adjusted under 35 U.S.C. 154(b) by 74 days.

(21) Appl. No.: 12/091,724

(22) PCT Filed: Oct. 27, 2005

(86) PCT No.: PCT/US2005/039200

§ 371 (c)(1),
(2), (4) Date: Dec. 24, 2008

(87) PCT Pub. No.: WO2007/050085

PCT Pub. Date: May 3, 2007

(65) Prior Publication Data

US 2009/0238592 A1 Sep. 24, 2009

(51) Int. Cl.
*G03G 15/16* (2006.01)

(52) U.S. Cl. ..... 399/66; 399/308; 430/125.3

(58) Field of Classification Search ..... 399/66, 399/302, 308, 43, 307, 45; 430/125.3, 125.32
See application file for complete search history.

(56) References Cited

U.S. PATENT DOCUMENTS 4,144,808 A 3/1979 Iwasa et al.
4,868,729 A * 9/1989 Suzuki ..... 399/88 X
4,974,027 A 11/1990 Landa et al.
5,974,281 A 10/1999 Fujii et al.
6,144,830 A * 11/2000 Kusaba et al. ..... 399/302
6,246,845 B1 * 6/2001 Hosoya et al. ..... 399/66
7,295,799 B2 * 11/2007 Marsh et al. ..... 399/66 X
2005/0008382 A1 1/2005 Taguchi et al.

FOREIGN PATENT DOCUMENTS

| | | |
|---|---|---|
| EP | 0795418 | 9/1997 |
| JP | 58063967 | 4/1983 |
| JP | 03289321 | 12/1991 |
| JP | 06015944 | 1/1994 |
| JP | 06035238 | 2/1994 |
| JP | 2002049249 | 2/2002 |

OTHER PUBLICATIONS

PCT International Search Report, Apr. 5, 2006.
Japan Patent Office, Notification of Reason For Refusal (Translated in English), Jun. 1, 2010; 4 pages.

* cited by examiner

*Primary Examiner*—Sophia S Chen

(57) ABSTRACT

An electrophotographic printing control apparatus serves for transferring an image via an electrically biasable ITM drum to a conductive substrate. The electrically biasable ITM drum is in contact with the conductive substrate over a contact period during which the image is transferred to the conductive substrate. The printing control apparatus includes a bias unit which provides electrical bias to the ITM drum and with short circuit protection, and a bias switching unit controllable to cut bias from the bias unit to the ITM drum during the contact period such that the ITM drum is unbiased when in contact with the conductive substrate.

19 Claims, 6 Drawing Sheets

PRINTING ON CONDUCTIVE SUBSTRATE MATERIAL

RELATED APPLICATIONS

This patent application claims priority to PCT/US2005/039200, having title "Printing on Conductive Substrate Material", filed on 27 Oct. 2005, commonly assigned herewith, and hereby incorporated by reference.

FIELD AND BACKGROUND OF THE INVENTION

The present invention relates to printing on conductive substrate material and, more particularly, but not exclusively to printing on webs of materials such as aluminum using an electrophotographic printing machine.

Electrophotographic printing machines generally use a two-transfer system of printing in which an electrophotographic image is formed on a first drum using a laser beam shone onto a photoelectric material. An electrostatic image is formed in the photoelectric material by the laser beam and then ink is drawn into the electrostatic image. The image so formed is then transferred in a first transfer operation onto a blanket carried by an intermediate transfer drum, known as the ITM drum. A second transfer operation occurs when the image is transferred from the blanket onto the printing substrate which is held on a third drum, known as the impression drum.

Printing devices for separate sheets of paper are known that print colors by carrying out separate transfer operations for each color. That is to say they rotate the printing substrate over the impression drum several times, each time transferring the image per one color. When printing on web, multiple rotation of the drum for a single section of printing is not possible since the web is continuous. Therefore machines for printing on web use what are known as one-shot printing techniques, in which all of the printing images for all of the colors are gathered on the ITM drum and then transferred in a single rotation onto the web substrate.

Referring now to the drawings, FIG. 1 schematically illustrates a cross sectional view of an electrostatic printing assembly 1, according to the teaching of prior art. Apparatus 1 comprises an electrostatic drum 10 arranged for rotation about an axle 12. Drum 10 is typically formed with an imaging surface 16, e.g., a photoconductive surface. Surface 16 is typically of a cylindrical shape.

A charging unit 18, which can be a corotron, a scorotron, a roller charger or any other suitable charging unit known in the art, uniformly charges surface 16, for example, with positive charge.

Continued rotation of the drum 10 brings surface 16 into image receiving relationship with an exposing unit 20, which focuses one or more scanning laser beams onto surface 16 to scan a desired image. The laser beams selectively discharge surface 16 in the areas struck by light, thereby forming an electrostatic latent image. Usually, the desired image is discharged by the light while the background areas are left electrostatically charged. Thus, the latent image normally includes image areas at a first electrical potential and background areas at another electrical potential. Unit 20 may be a modulated laser beam scanning device, an optical focusing device or any other imaging device known in the art.

Continued rotation of the drum 10 brings imaging surface 16, now bearing the electrostatic latent image, into a developing unit 22, which typically comprises electrodes 24 operative to apply a liquid toner or ink on surface 16, so as to develop the electrostatic latent image. The liquid toner can comprise charged solid particulates dispersed in a carrier liquid. The solid particulates are typically charged to the same polarity of the photoconductor. Thus, due to electrostatic repulsion forces, ink particles adhere to areas on the photoconductor corresponding to the image regions, substantially without adhering to (developing) the background regions. In this manner a developed image is formed on surface 16.

Following application of liquid toner thereto, surface 16 typically passes through other rollers (not shown) which ensure that the ink surface is appropriate for transfer to ITM drum 40. A first ink transfer then occurs, in which the liquid image is transferred, typically via electrostatic attraction, from drum 10 to ITM drum 40, rotating in the opposite direction 41 of drum 10. In order for the first transfer to occur, an electrical bias is needed in the direction of image transfer. The drums are therefore generally biased negatively by a bias unit 44, so that a forward bias leads from electrostatic drum 10 to ITM drum 40.

Subsequently, the image experiences a second transfer, typically aided by heat and pressure, from ITM drum 40 to a substrate 42, which is supported by an impression drum 43.

Following the transfer of the liquid image to ITM drum 40, imaging surface 16 is cleaned to remove ink traces. Residual charge left on surface 16 can be removed, e.g., by flooding surface 16 with light from a lamp 58.

The electronic biasing provided by biasing unit 44 is problematic for printing on a conductive web substrate. Biasing unit 44 typically utilizes a voltage source-type power supply with a high voltage rating. The power supply is designed to fail when a high current is drawn, bringing about collapse of the bias path and thus failure of printing. Generally such failure only occurs in the rare event of a short circuit within the printing machine, however a problem arises when the web being printed is conductive, for example in the case of printing on aluminum sheet, say in the form of foil. In such a case the conductive substrate must contact the drum for the ink transfer to succeed. However, at the time the ink is being transferred to the substrate, ink is already being transferred to the ITM drum for the next operation, so as not to lose cycles within the machine. Thus a short circuit is formed through the printing substrate which is itself conductive, to earthed parts of the printing machine, giving rise to current leakage which is generally sufficient to collapse the bias and therefore stop the printing.

In the past a solution was found to allow the printing of conductive webs by isolating the conductive printing substrate from the rest of the machine. However such a solution is not practical in machines with sophisticated web feeding elements such as suction elements, since the suction elements are themselves made of conducting material and have to contact the web in order to work.

There is thus a widely recognized need for, and it would be highly advantageous to have, a means that would allow electrophotographic printing of conductive web substrates without being liable to current leakage.

SUMMARY OF THE INVENTION

According to a first aspect of the present invention there is provided an electrophotographic printing control apparatus serves for transferring an image via an electrically biasable ITM drum to a conductive substrate. The electrically biasable ITM drum is in contact with the conductive substrate over a contact period during which the image is transferred to the conductive substrate. The printing control apparatus includes a bias unit which provides electrical bias to the ITM drum and with short circuit protection, and a bias switching unit controllable to cut bias from the bias unit to the ITM drum during the contact period such that the ITM drum is unbiased when in contact with the conductive substrate.

According to a second aspect of the present invention there is provided an electrophotographic printing control apparatus for transferring an image via an electrically biasable ITM drum to a conductive substrate. The electrically biasable ITM drum is in contact with the conductive substrate over a contact period during which the image is transferred to the conductive substrate. The printing control apparatus includes a bias unit which provides electrical bias to the ITM drum and with short circuit protection, and a switching and control unit. The switching and control unit cuts the bias from the bias unit to the ITM drum during the contact period so that the ITM drum is unbiased when in contact with the conductive substrate. The switching and control unit also suspends a first image transfer to the electrically biasable ITM drum during the contact period by introducing a first and a second null cycles of the electrostatic drum, such that the contact period extends from within the first null cycle to within the second null cycle.

According to a third aspect of the present invention there is provided an electrophotographic printing control apparatus for transferring an image via an electrically biasable ITM drum to a conductive substrate. The electrically biasable ITM drum is in contact with the conductive substrate over a contact period during which the image is transferred to the conductive substrate. printing control apparatus includes a means for providing electrical bias to the ITM drum and a means for cutting bias from the bias unit to the ITM drum during the contact period such that the ITM drum is unbiased when in contact with the conductive substrate.

According to a fourth aspect of the present invention there is provided a method of printing a conductive substrate using electrophotographic printing. The method is performed by applying bias to a drum-based image transfer mechanism, under the bias carrying out a first image transfer over the transfer mechanism, disconnecting the bias, and carrying out a second image transfer from the drum-based image transfer mechanism to the conductive web.

Unless otherwise defined, all technical and scientific terms used herein have the same meaning as commonly understood by one of ordinary skill in the art to which this invention belongs. The materials, methods, and examples provided herein are illustrative only and not intended to be limiting.

Implementation of the method and system of the present invention involves performing or completing certain selected tasks or steps manually, automatically, or a combination thereof. Moreover, according to actual instrumentation and equipment of preferred embodiments of the method and system of the present invention, several selected steps could be implemented by hardware or by software on any operating system of any firmware or a combination thereof. For example, as hardware, selected steps of the invention could be implemented as a chip or a circuit. As software, selected steps of the invention could be implemented as a plurality of software instructions being executed by a computer using any suitable operating system. In any case, selected steps of the method and system of the invention could be described as being performed by a data processor, such as a computing platform for executing a plurality of instructions.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in order to provide what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF THE PREFERRED EMBODIMENTS

Figure 1:
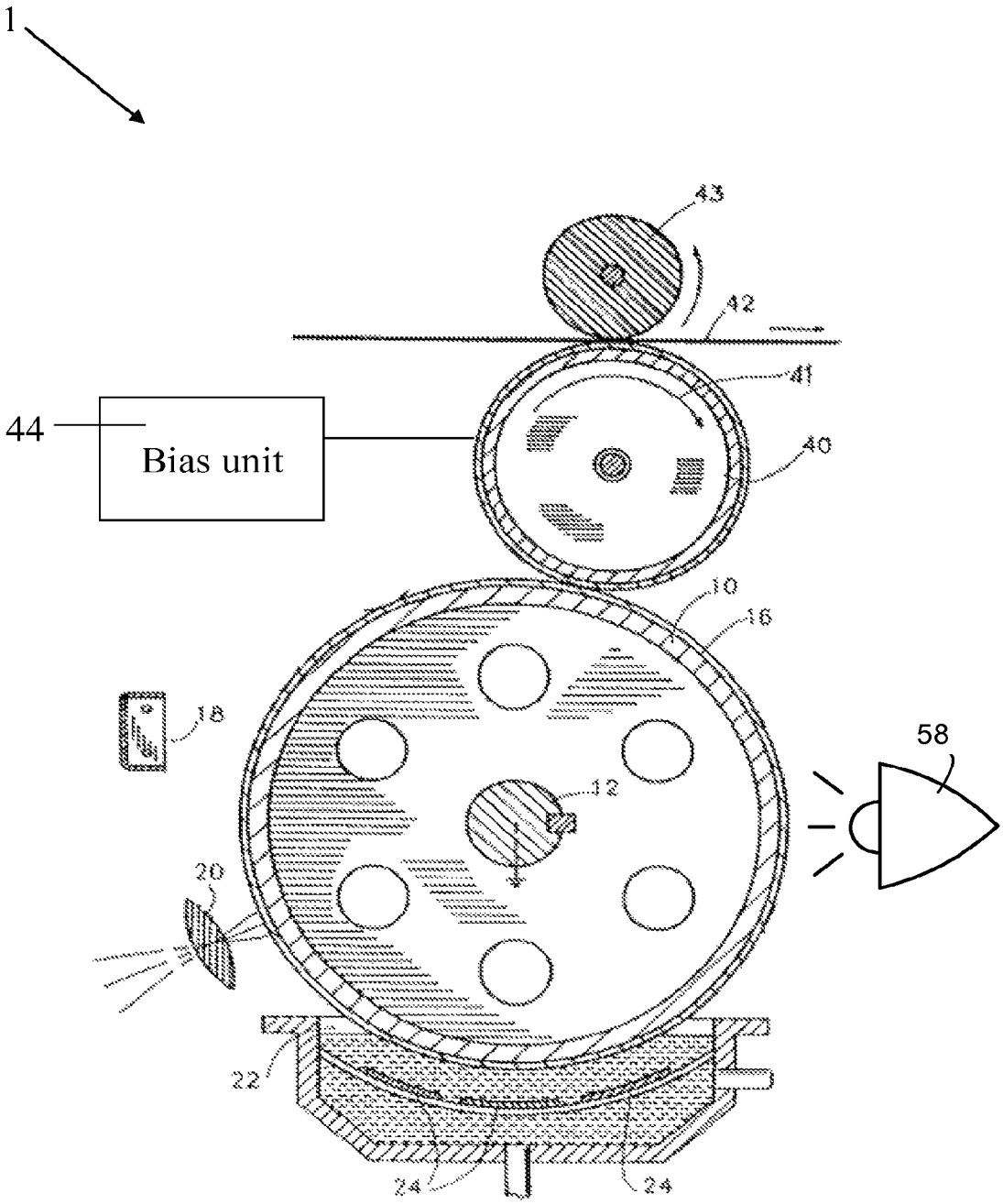
Fig. 1 (Prior Art)
FIG. 1 schematically illustrates a cross sectional view of a prior-art electrostatic printing apparatus.

The present embodiments comprise an apparatus and a method for printing on a conductive web substrate.

In the present embodiments, printing on a conductive substrate is performed on an electrophotographic printer by removing the electrical bias to the ITM drum at all times that the ITM drum is in contact with the conductive substrate, specifically during the second ink transfer. Thus no current surge is detected by the bias unit during image transfer to the conductive substrate, and a shutdown of the bias unit is prevented. While the bias unit is disconnected, other operations that need bias on the ITM drum (such as the transfer of the image from the electrostatic drum to the ITM drum) are avoided. In a further embodiment, such operations are suspended during periods in which the ITM drum is unbiased by adding one or more null cycles (during which the drums turn but no printing substrate is fed through) for each printed image. As will be discussed below, the addition of null cycles reduces the throughput of the printer, but enables printing on conductive web substrates.

The principles and operation of an apparatus and method according to the present invention may be better understood with reference to the drawings and accompanying description.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Parts that are the same as those in previous figures are given the same reference numerals and are not described again except as necessary for an understanding of the present embodiment. In the following the term "first transfer" refers to image transfer from the electrostatic drum to the ITM drum, and the term "second transfer" refers to image transfer from the ITM drum to the substrate.

Figure 2:
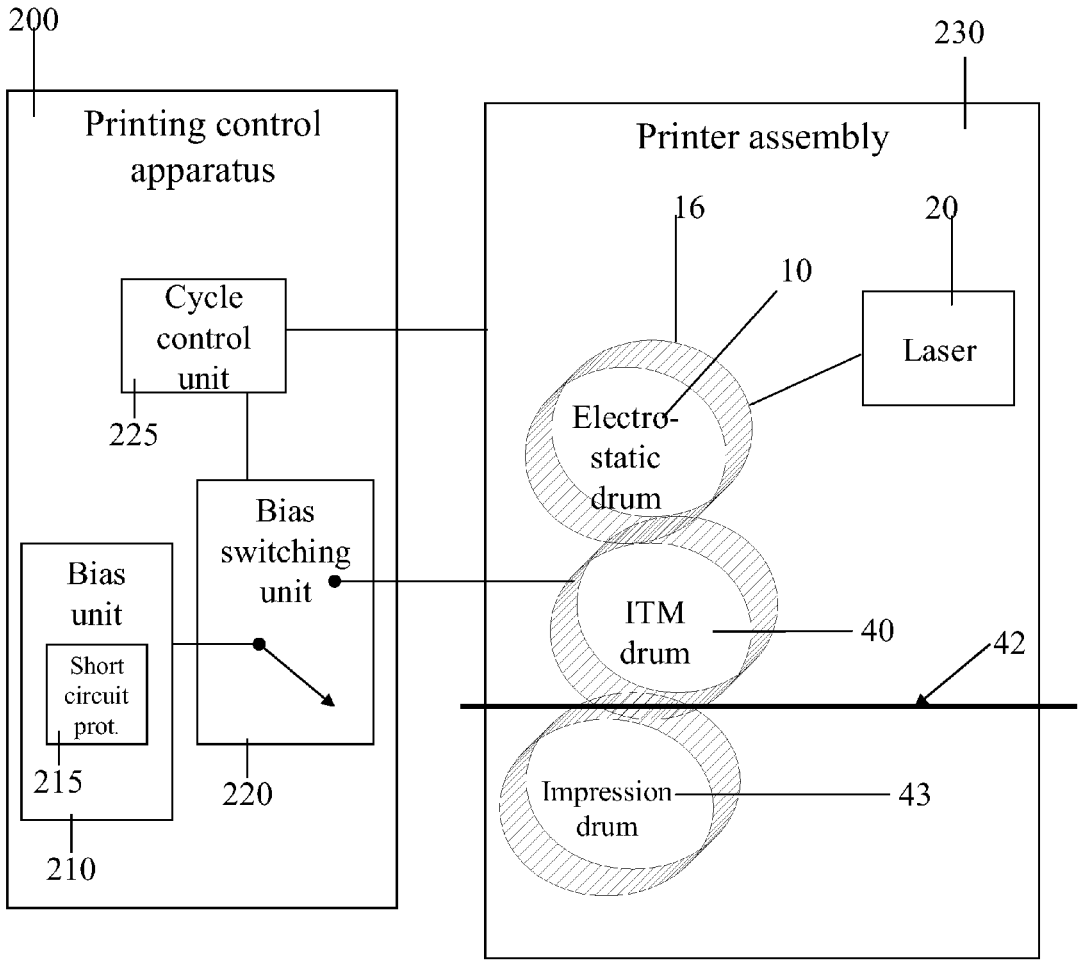
FIG. 2 is a simplified block diagram of an electrophotographic printing control apparatus according to an embodiment of the present invention.

Reference is now made to FIG. 2 which is a simplified block diagram of an electrophotographic printing control apparatus according to an embodiment of the present invention. Printing control apparatus 200 provides biasing and control to a printer assembly 230 with an electrically biasable ITM drum 40, and operating substantially as described above. As discussed above, electrical biasing of ITM drum 40 ensures the transfer of ink from electrostatic drum 10 to ITM drum 40.

Printing control apparatus 200 contains bias unit 210, which provides electrical bias to ITM drum 40, and bias switching unit 220. Bias unit 210 has short circuit protection 215 which shuts down electrical biasing when a current surge is detected. Bias switching unit 220 serves to cut off the bias from bias unit 210 to the ITM drum during the contact period, so that ITM drum 40 is unbiased when in contact with the conductive substrate 42.

In an additional embodiment, printing control apparatus 200 further includes cycle control unit 225, which switches printing assembly 230 between first transfer operations and the second transfer operations. Cycle control unit 225 and bias switching unit 220 thus work in concert to time the transfer cycles and biasing cycles so that biasing is applied only at the appropriate times in the image transfer process.

The cycle control unit 225 may be configured to ensure that the first transfer (from electrostatic drum 10 to ITM drum 40) and the second transfer (from ITM drum 40 to substrate 42) are offset temporally. Thus bias switching unit 220 can apply electrical biasing for the first ink transfer, and turn off electrical biasing for the second ink transfer during which ITM drum 40 is in contact with conductive substrate 42. Consequently, no conductive path is formed via conductive substrate 42, the short circuit protection 215 of bias unit 210 is not activated, and printing on conductive substrate 42 may be accomplished. Printing control apparatus 200 is appropriate for printing on a conductive web substrate, for which the prior-art solution of isolating conductive substrate 42 from the rest of the printer is particularly difficult to implement.

In a further embodiment, cycle control unit 225 is configured to provide a first delay between removing the bias voltage and starting the second transfer. The delay enables decay of the bias voltage before ITM drum 40 makes contact with substrate 42. Likewise, cycle control unit 225 may provide a delay at the end of the second transfer to enable the bias voltage to rise to the required level before the next first transfer stage is performed.

Figure 3:
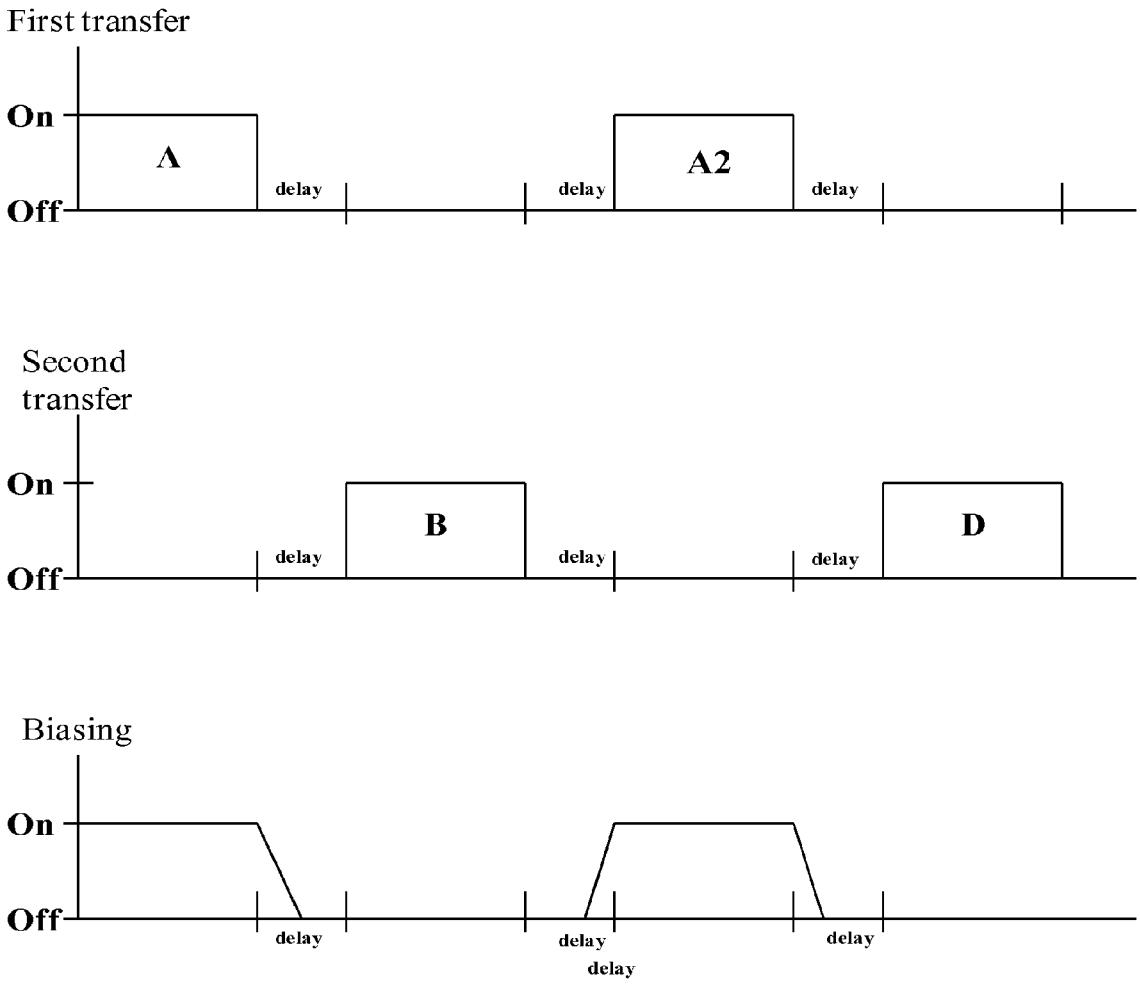
FIG. 3 is a simplified timing diagram of ITM drum biasing, relative to the first and second image transfer cycles, according to an embodiment of the present invention.

Reference is now made to FIG. 3 which is a simplified timing diagram of ITM biasing relative to the first and second transfer cycles, according to the present embodiment. In stage A, the first transfer is performed with biasing voltage on, to transfer the image to the ITM drum. Following stage A, a delay period occurs to enable the decay of the bias voltage prior to beginning the image transfer to the substrate in stage B. After stage B, a delay period occurs to enable the bias voltage to rise to the required level. The next printing cycle then begins at stage A2, with a new image transfer to the ITM drum. Following stage A2, a delay period occurs to enable the decay of the bias voltage prior to beginning the image transfer to the substrate in stage D. It is readily seen from FIG. 3 that a biasing voltage is present for first transfer operations, but is not present for second transfer operations.

In a typical four-shot printer, a separate printing assembly (i.e. electrostatic drum, ITM drum and impression drum) is provided for each color, and the different colors are applied consecutively to the substrate in order to form a color image. Commonly the second transfer of each ink layer starts about half a cycle after the first transfer. This means that the second transfer of each layer starts at the middle of the first transfer of the same layer and ends during the first transfer of the next layer.

In one-shot printers all the ink layers are first accumulated on the ITM drum by performing a series of first transfer operations. A single second transfer operation then transfers all layers (i.e. colors) to the substrate. In one-shot printers, the second transfer typically starts at the middle of the first transfer of the final layer of the current image, and ends during the first transfer of the next image. If the abovedescribed timing of the transfer cycles is maintained for printing a conductive web substrate, cutting the electrical bias to the ITM drum during the second transfer may interfere with the first transfer of two ink layers.

In a further embodiment, null cycles are introduced into the printing cycle, during which first transfer operations are suspended. In the present embodiment, cycle control unit 225 suspends the first image transfer to ITM drum 40 during the contact period by introducing one or more null cycles, desirably two, of the electrostatic drum. During the null cycles, the drums spin but no web substrate is fed through printer assembly 230. The second transfer may then be performed from a mid-point of the first null cycle until a mid-point of the second one, without interfering with the first transfer process. In this case, all first transfers are performed with full bias and there is still ample time for bias decay and rise time. Contact between the ITM drum and the substrate is prevented during those times that a bias is applied.

Figure 4:
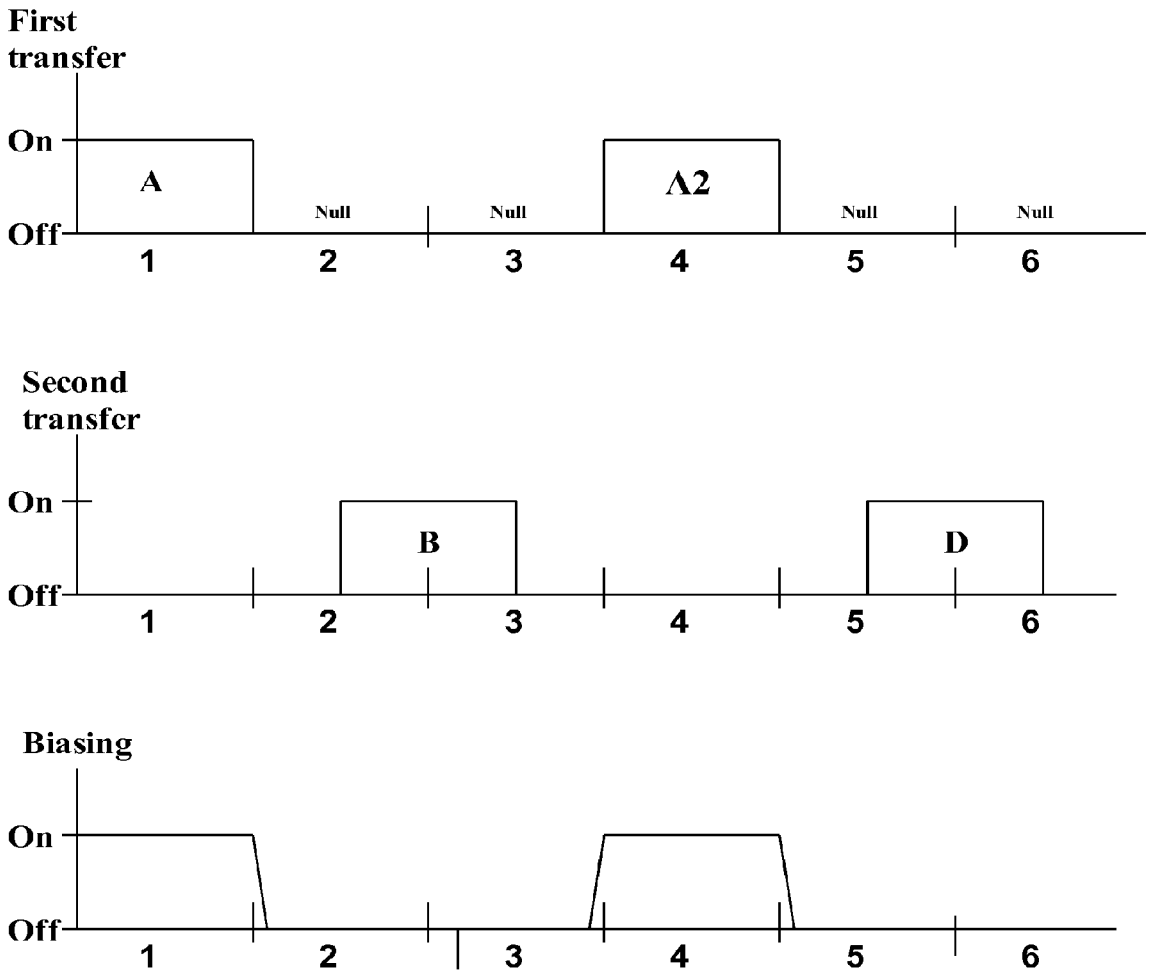
FIG. 4 is a simplified timing diagram of ITM biasing for a printing cycle which includes two null periods for a single color image, according to an embodiment of the present invention.

Reference is now made to FIG. 4 which is a simplified timing diagram of ITM drum biasing for a print cycle which includes two null periods after transferring a single color to the ITM drum. During cycle 1 (stage A), the first transfer is performed with biasing voltage on, to transfer the image to the ITM drum. Following stage A, two null cycles (cycles 2 and 3) occur during which first image transfer operations are suspended. The second image transfer in stage B is performed in the middle of the two null cycles, after the biasing voltage has decayed. The biasing voltage is then reapplied, and stage A2 is performed during cycle four, after the two null cycles. Following stage A2, another set of two null cycles (cycles 5 and 6) occur during which first image transfer operations are suspended. Like the second image transfer in stage B, the second image transfer in stage D is performed in the middle of the two null cycles, after the biasing voltage has decayed.

For one-shot printing of four-color images on a conductive substrate, two null cycles are added for each four cycles, and productivity is reduced by one third. In practice, the conductive substrates are aluminum and white ink is printed under the image in order to give normal colors to the printed image. In this case, the image has six ink layers (YMCK and two white layers). and one null cycle is typically added to enhance image drying. In this case only one more null cycle is added for the present embodiment. This results in productivity reduction of approximately 14 percent.

Figure 5:
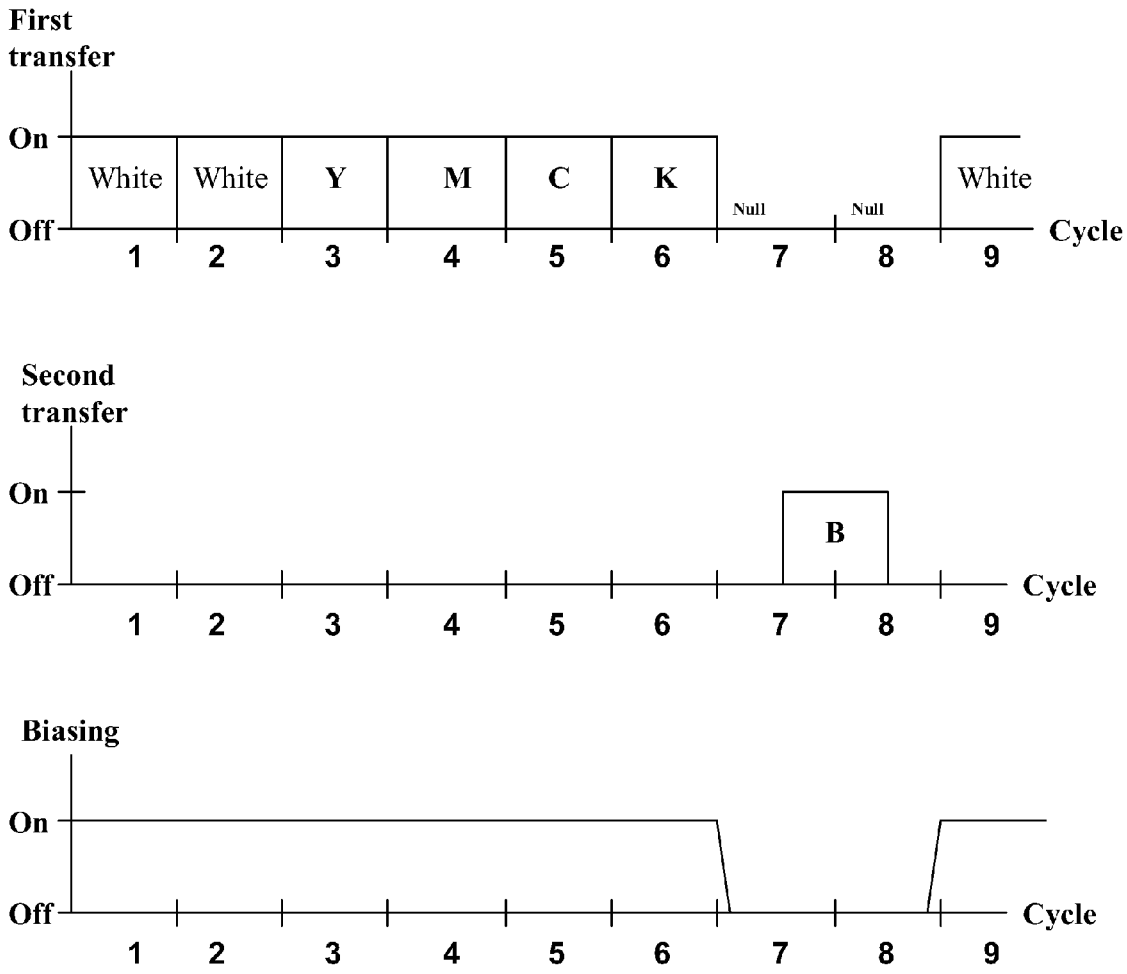
FIG. 5 is a simplified timing diagram of for a one-shot YMCK (yellow, magenta, cyan, and black) printer which applies two layers of white ink followed by the four colors, according to an embodiment of the present invention.

FIG. 5 illustrates the timing for a one-shot YMCK (yellow, magenta, cyan, and black) printer which applies two layers of white ink followed by the four colors. During cycles 1-6, six consecutive first transfers are performed to apply the two white layers and the four colors to the ITM drum. Cycles 7 and 8 are null cycles during which first transfer operations are not performed. During stage B, a single second transfer operation transfers the multi-color image to the substrate. Stage B is performed in the middle of cycles 7 and 8, after the bias voltage has decayed. After the two null cycles, at the end of cycle 9, biasing is restored and image transfer to the ITM drum resumes.

Figure 6:
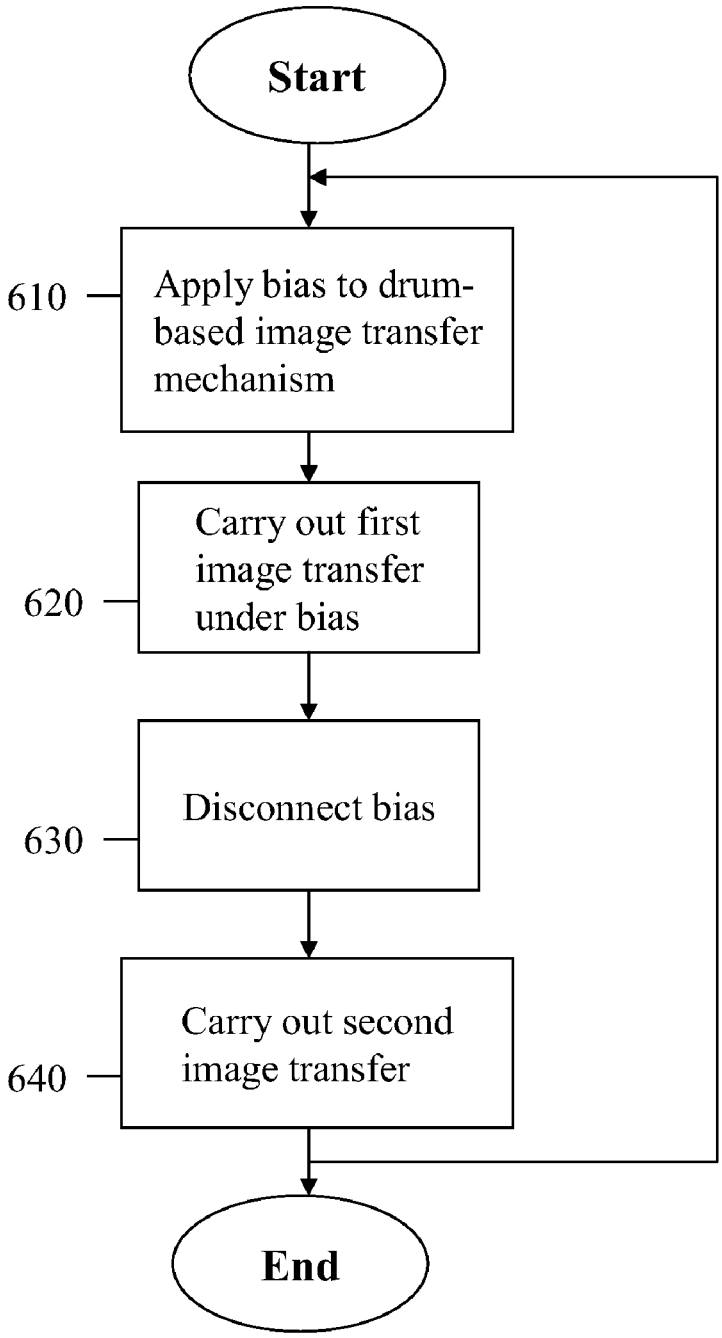
FIG. 6 is a simplified flowchart of a method of printing a conductive substrate using electrophotographic printing, according to an embodiment of the present invention.

Reference is now made to FIG. 6, which is a simplified flowchart of a method for printing a conductive substrate using electrophotographic printing, according to an embodiment of the present invention. In step 610 a bias is applied to a drum-based image transfer mechanism. Under the bias, a first image transfer is carried out over the transfer mechanism in step 620. In step 630 the bias is disconnected, desirably substantially at a midpoint of the first null cycle. Finally, a second image transfer from the drum-based image transfer mechanism to the conductive web is carried out in step 640.

The present method may also include the step of adding a first null cycle of an image electrostatic source drum of the drum-based image transfer mechanism between the first transfer and the second transfer and adding a second null cycle following the second image transfer and preceding a first image transfer of a next image. When the conductive substrate is aluminum, requiring printing of white layers and a drying null cycle for ink drying, the drying null cycle may be used as one of the first and second null cycles.

It is expected that during the life of this patent many relevant devices and systems will be developed and the scope of the terms herein, particularly of the terms electrophotographic printing, image transfer, biasing, and conductive substrate is intended to include all such new technologies a priori.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents, and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. Electrophotographic printing control apparatus for transferring an image via an electrically biasable intermediate transfer (ITM) drum to a conductive substrate, said electrically biasable ITM drum being in contact with said conductive substrate over a contact period during which said image is transferred to said conductive substrate, the apparatus comprising:

a bias unit with short circuit protection, said bias unit for providing electrical bias to said ITM drum; and a bias switching unit controllable to cut bias from said bias unit to said ITM drum during said contact period such that said ITM drum is unbiased when in contact with said conductive substrate.

2. Apparatus according to claim 1, further comprising a cycle control unit associated with said bias switching unit, operable to suspend a first image transfer to said electrically biasable ITM drum during said contact period.

3. Apparatus according to claim 2, further comprising an electrostatic drum from which said first image transfer to said ITM drum is carried out, wherein said suspending image transfer to said electrically biasable ITM drum comprises introducing a null cycle of said electrostatic drum.

4. Apparatus according to claim 3, wherein said cycle control unit is configured to introduce two of said null cycles per image printing operation, such that said contact period extends from within said first null cycle to within said second null cycle.

5. Apparatus according to claim 4, wherein said contact period extends from substantially a mid-point of said first null cycle to substantially a mid-point of said second null cycle.

6. Apparatus according to claim 5, wherein said contact period extends from a mid-point of said first null cycle to a mid-point of said second null cycle.

7. Apparatus according to claim 2, configured to carry out a first image transfer to said ITM drum and said image transfer to said substrate as a second transfer, wherein said cycle control unit is configured such that said first transfer and said second transfer are offset temporally.

8. Apparatus according to claim 7, wherein said cycle control unit is configured such that said bias is applied during said first transfer and is not applied during said second transfer.

9. Apparatus according to claim 8, wherein said cycle control unit is configured to provide a first delay between removing said bias and starting said second transfer.

10. Apparatus according to claim 9, wherein said first delay is set such as to allow bias decay before said second transfer begins.

11. Apparatus according to claim 9, wherein said cycle control unit is configured to provide a second delay between an end of said second transfer and reapplying said bias.

12. Apparatus according to claim 11, wherein said second delay is set such as to allow for bias rise time.

13. Apparatus according to claim 1, wherein said substrate is a conductive web.

14. Electrophotographic printing control apparatus for transferring an image via an electrically biasable intermediate transfer (ITM) drum to a conductive substrate, said electrically biasable ITM drum being in contact with said conductive substrate over a contact period during which said image is transferred to said conductive substrate, the apparatus comprising:

a bias unit with short circuit protection, said bias unit for providing electrical bias to said ITM drum; and a switching and control unit controllable to cut bias from said bias unit to said ITM drum during said contact period such that said ITM drum is unbiased when in contact with said conductive substrate, and to suspend a first image transfer to said electrically biasable ITM drum during said contact period by introducing a first and a second null cycles of an electrostatic drum, such that said contact period extends from within said first null cycle to within said second null cycle.

15. Electrophotographic printing control apparatus for transferring an image via an electrically biasable intermediate transfer (ITM) drum to a conductive substrate, said electrically biasable ITM drum being in contact with said conductive substrate over a contact period during which said image is transferred to said conductive substrate, the apparatus comprising:

a means for providing electrical bias to said ITM drum; and a means for cutting bias from a bias unit to said ITM drum during said contact period such that said ITM drum is unbiased when in contact with said conductive substrate.

16. Method of printing a conductive substrate using electrophotographic printing, the method comprising:

applying bias to a drum-based image transfer mechanism;

under said bias carrying out a first image transfer over said transfer mechanism;

disconnecting said bias; and while said bias is disconnected, carrying out a second image transfer from said drum-based image transfer mechanism to said conductive substrate.

17. The method of claim 16, comprising adding a first null cycle of an image electrostatic source drum of said drum-based image transfer mechanism between said first image transfer and said second image transfer and adding a second null cycle following said second image transfer and preceding a first image transfer of a next image.

18. The method of claim 17, wherein said conductive substrate is aluminum, requiring printing of white layers and a drying null cycle for ink drying, the method comprising using said drying null cycle as one of said first and second null cycles.

19. The method of claim 16, wherein said disconnecting said bias is carried out substantially at a midpoint of said first null cycle.

* * * * *

UNITED STATES PATENT AND TRADEMARK OFFICE

CERTIFICATE OF CORRECTION

PATENT NO. : 7,813,661 B2
APPLICATION NO. : 12/091724
DATED : October 12, 2010
INVENTOR(S) : Naseem Yacoub et al.

It is certified that error appears in the above-identified patent and that said Letters Patent is hereby corrected as shown below:

On the title page, item (73), Assignee, in column 1, line 1, delete "Hewett-Packard" and insert -- Hewlett-Packard --, therefor.

Signed and Sealed this
Twenty-ninth Day of March, 2011

David J. Kappos

David J. Kappos
*Director of the United States Patent and Trademark Office*